US006357829B1

(12) United States Patent
Hanke

(10) Patent No.: US 6,357,829 B1
(45) Date of Patent: Mar. 19, 2002

(54) CONTOURED BODY CUSHION

(75) Inventor: Robert C. Hanke, Enfield, CT (US)

(73) Assignee: Colby Enterprises, Enfield, CT (US)

( * ) Notice: Subject to any disclaimer, the term of this patent is extended or adjusted under 35 U.S.C. 154(b) by 0 days.

(21) Appl. No.: 09/558,017

(22) Filed: Apr. 25, 2000

Related U.S. Application Data

(60) Provisional application No. 60/132,367, filed on May 4, 1999.

(51) Int. Cl.[7] ..... A47C 7/52

(52) U.S. Cl. ..... 297/452.28; 297/452.21; 297/219.1; 297/229; 5/630; 5/632; 5/925

(58) Field of Search ..... 297/452.28, 219.1, 297/452.21, 452.26, 452.32, 452.3, 452.23, 452.25, 452.33, 452.34, 229, DIG. 1; 5/632, 630, 653, 925

(56) References Cited

U.S. PATENT DOCUMENTS 2,847,061 A * 8/1958 Morton ..... 297/452.28
3,890,004 A * 6/1975 Rail ..... 297/452.21 X
4,185,813 A * 1/1980 Spann ..... 5/630 X
4,615,856 A * 10/1986 Silverman ..... 297/452.28 X
4,621,004 A * 11/1986 Madsen ..... 297/229 X
4,630,863 A 12/1986 Roberts ..... 297/219.1
4,805,605 A 2/1989 Glassman
5,383,920 A 1/1995 Sikes
5,403,066 A 4/1995 Drum ..... 297/219.1
5,735,004 A * 4/1998 Wooten et al. ..... 5/925
5,740,567 A * 4/1998 Mitchell ..... 5/925 X
5,742,963 A * 4/1998 Trevino et al. ..... 5/632
5,809,595 A * 9/1998 Stevens et al. ..... 5/925 X
5,944,380 A * 8/1999 Atherley ..... 297/DIG. 1 X
5,987,675 A * 11/1999 Kim ..... 5/632

* cited by examiner

*Primary Examiner*—Peter M. Cuomo
*Assistant Examiner*—Rodney B. White
(74) *Attorney, Agent, or Firm*—Cantor Colburn LLP

(57) ABSTRACT

A body cushion, comprising: a posterior portion for placement against the posterior of a user; and a pair of leg extensions integrally formed with the posterior portion and extending therefrom, the leg extensions for placement against the upper portions of the legs of the user, wherein each of the leg extensions includes extendable features which permit the leg extensions to extend and contract along a length thereof.

15 Claims, 4 Drawing Sheets

CONTOURED BODY CUSHION

CROSS REFERENCE TO RELATED APPLICATIONS

This application claims the benefit of U.S. application Ser. No. 60/132,367, filed on May 4, 1999, which is hereby incorporated by reference in its entirety.

TECHNICAL FIELD

The present inventions relates generally to a seating device, and more specifically, the present invention relates to a body cushion which is specially contoured for a person's body and which is particularly suited for use in a variety of sporting applications.

BACKGROUND OF THE INVENTION

Over the years, it has been increasingly popular to use a portable seat cushion for support and comfort while attending and viewing sporting events in a stadium or the like, and these same seat cushions are also used by participants of sports which require prolonged periods of sitting. For example and as is known, the sports of fishing and gamesmanship (i.e., hunting), generally require the participant to sit in a set location for prolonged periods of time. Typically, this location comprises a metal seating area in a boat or a seating area in a hunting structure designed to protect and camouflage the individual from the game which is being sought. As such, the posterior of the individual is likely to become very sore by sitting on a hard surface for prolonged periods of time.

To alleviate the discomfort caused by sitting on these hard surfaces, it is common for an individual to bring a seat cushion, commonly referred to as a stadium seat. The seat cushion typically has a plastic outer coating surrounding a cushion material disposed therein. Air holes are provided in the outer coating to permit air to escape as the individual sits on the pad and the seat cushion contracts, thereby forcing air out from the center thereof. Usually, a pair of side straps are formed with and extend from the outer coating. These side straps permit the user to easily carry the seat cushion and place it in a desired location on the hard seating surface. The seat cushion is typically in the shape of a rectangle.

While the conventional seating cushions of the prior art are suitable for some uses, they suffer from the disadvantage that the seating cushions are generally not contoured to the user's body for providing extra comfort and more importantly, the seating cushions are designed to be carried by the user and then placed on the hard seating surface as the user sits down. Consequently, if the user decides to move positions or slightly rise to observe an event or an object, the seating cushion is free to become displaced from its original setting. In addition, external conditions, such as wind, can cause the seat cushion to become misplaced. This causes difficulties when the user is involved in a sport such as fishing or hunting because the user does not have much time to continually observe the position of the seating cushion as the user sits back down on the seating surface. It is desirable for a hunter or fishing participant to be able to rise from the seating surface, conduct a series of movements and then sit back down without having to worry about the location of the seating cushion.

Thus, it can be seen that it would be advantageous to have a seating cushion which is body contoured and permits the user to move without worry.

SUMMARY OF THE INVENTION

The above-discussed and other drawbacks and deficiencies of the prior art are overcome or alleviated by the body cushion of the present invention. The body cushion comprises a posterior portion to accommodate the posterior of a user and a pair of leg extensions which extend therefrom. According to the present invention, the posterior portion and the leg extensions are preferably contoured to the shape of the user's body so that a secure fit results when the user wears the body cushion. The body cushion is designed to be secured to the lower half of the user's body by a number of fastening devices, e.g, interlockable belts, which are disposed in the body cushion.

More specifically, a waist belt is provided at a topmost end of the posterior portion and a leg belt is provided at the bottommost end of the leg extension. The leg extensions are preferably integrally formed with the posterior portion, and in a preferred embodiment, the body cushion is formed of a closed cell foam by known processes. The posterior portion seats against the buttocks area of the user and the leg extensions seat against the backside of the user's legs.

The leg extensions include pleated portions which easily extend to permit movement of the user and to provide extended comfort and protection when the user sits down a hard seating surface with the body cushion securely affixed to the user's posterior and to the backside of the user's legs.

BRIEF DESCRIPTION OF THE DRAWINGS

Referring now to the drawings wherein like elements are numbered alike in the several FIGURES.

Figure 1:
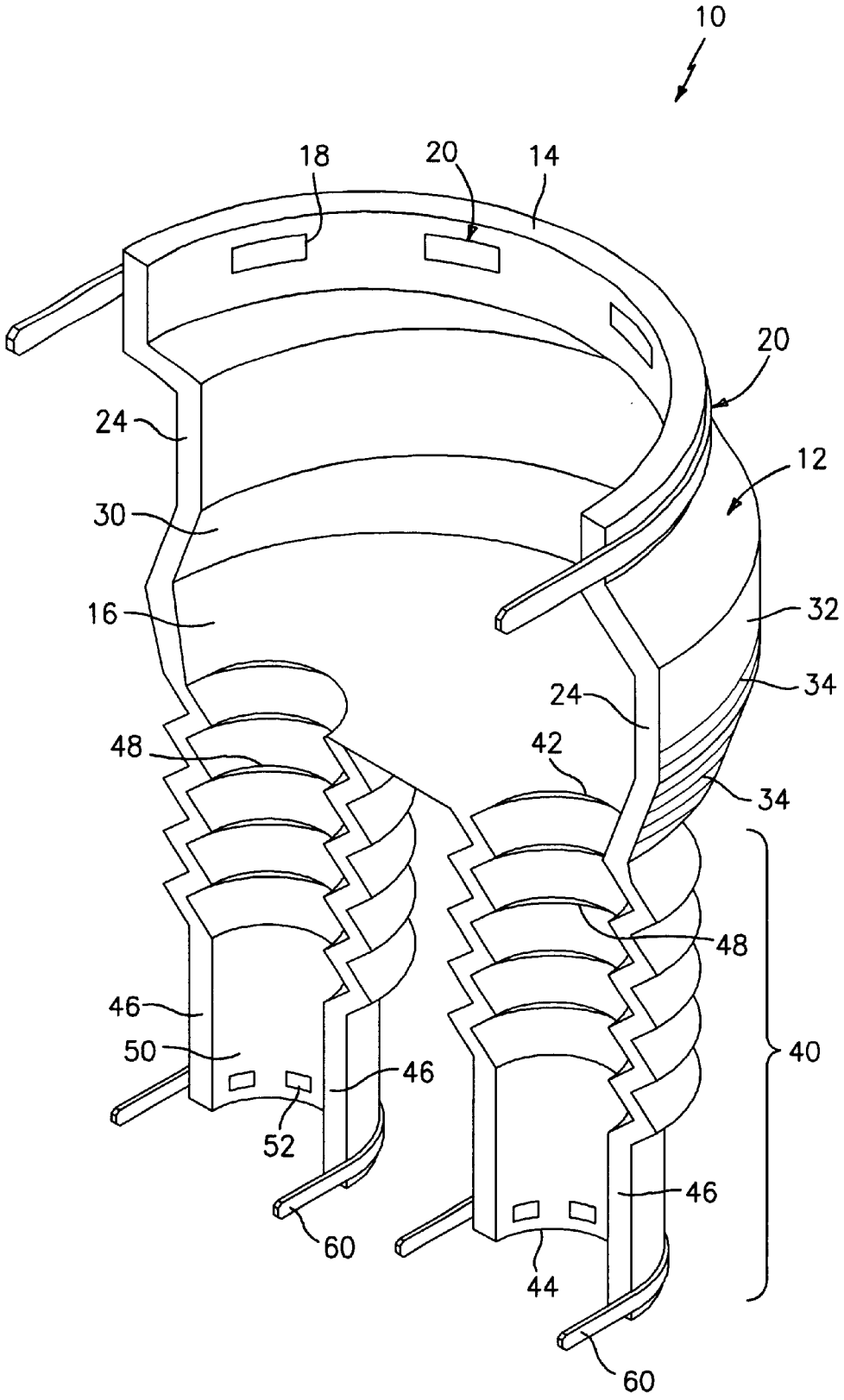
FIG. 1 is a front perspective view of an exemplary body pad in accordance with a first embodiment of the present invention.

DESCRIPTION OF THE PREFERRED EMBODIMENT:

Referring to FIGS. 1–3 and FIG. 6, a body cushion or seat cushion is illustrated and generally indicated at 10. Body cushion 10 includes a central posterior portion 12 having a first end 14 and an opposite second end 16, with first end 14 being generally positioned around the waist of a user when body cushion 10 is properly worn by the user. At first end 14, a plurality of slots 18 are formed in body cushion 10 for receiving a waist fastener 20. Waist fastener 20 is preferably an adjustable belt formed of a known material. For example and as shown in FIG. 7, a polyweb belt 20 having an adjustable side interlocking buckle assembly 22 is suitable for use in the present invention. Waist fastener 20 is designed to slidingly fit within the plurality of slots 18 so that the user may easily adjust fastener 20 and interlock buckle assembly 22 so as to secure first end 14 around the user's waist. Another aspect of waist fastener 20 is that it is designed to hold common accessories, such as knifes, flash lights, canteens, fanny packs, etc., by sliding one of these items along waist fastener 20, which is preferably a polyweb belt.

Posterior portion 12 is slightly arcuate in nature, as best shown in FIG. 1, so that body cushion 10 is contoured to fit the natural shape of the user's body. More specifically, posterior portion 12 has wrap around sides 24 which extend upward in a slightly arcuate manner so that wrap around sides 24 snugly secure the body of the user within body cushion 10. In other words, by providing a snug fit, body cushion 10 eliminates the likelihood that posterior portion 12 will freely ride along the posterior of the user.

Posterior portion 12 has an outer surface 30 and an inner surface 32. During use, inner surface 30 is in contact with the posterior of the user and outer surface 32 faces outward from the posterior and when the user sits, outer surface 32 will contact the seating surface. Formed within outer surface 32 is a plurality of ribs 34 which reduce slipping of body cushion 10 on the seating surface when the user sits down and/or moves along the seating surface.

In accordance with the present invention, a pair of leg extensions 40 extend from posterior portion 12 and are designed to be securely positioned around the backside of each of the user's legs just above the knee. Preferably, leg extensions 40 are integrally formed with posterior portion 12, as will be described in further detail hereinafter. Each of leg extensions 40 has a first end 42 and an opposite second end 44, wherein first end 42 is preferably integral with second end 16 of posterior portion 12 and second end 44 is positioned proximate the knee on the back side of the user's legs. Leg extensions 40 are also slightly arcuate in nature and include wrap around sides 46 which position and properly locate the user's legs within leg extensions 40. In an exemplary embodiment, each of leg extensions 40 is approximately 10 inches in length. It being understood that this length is merely exemplary in nature and that the length of leg extensions 40 may be either increased or decreased accordingly.

In one aspect of the present invention, each of leg extensions 40 includes a pleated portion 48 and a lower portion 50 which is generally below the pleated portion 48. Pleated portion 48 comprises a plurality of pleats formed in leg extension 40. In an exemplary embodiment, pleated portion 48 has a normal length of approximately 6 inches and in a retracted state, pleated portion 48 extends to a length of approximately 9 inches, thus leg extension 40 is capable of extending to accommodate the movement of the user who is wearing body cushion 10. Thus, normal stretching movements which are likely encountered during movement (e.g, sitting motion, walking motion, and the like) of the user with the body cushion 10 attached to the posterior portion of the user is accommodated by the extendable pleated portion 48.

Lower portion 50 is the part of the leg extension 40 which extends below pleated portion 40 in a direction away from posterior portion 12. In a preferred embodiment, lower portion 50 does not include the plurality of pleats but instead is slightly arcuate in shape so that it is contoured to the natural shape of the legs of the user. Preferably, lower portion 50 is approximately 4 inches in length and has a thickness of about ¾ inch.

In addition, lower portion 50 also includes a plurality of slots 52 which receive a leg fastener 60 on each of the user's legs. Leg fastener 60 is preferably an adjustable belt formed of a known material. In a preferred embodiment, leg fastener 60 comprises the polyweb belt 20 shown in FIG. 7. In the embodiment, polyweb belt 60 includes an adjustable side interlocking buckle assembly. Leg fastener 60 is designed to slidingly fit within the plurality of slots 52 so that the user may easily adjust fastener 60 and the interlock buckle assembly so as to secure lower portion 50 of leg extension 60 around the user's leg.

Accordingly, in a preferred embodiment, leg extensions 40 can cover, in an extended state, approximately 13 inches of the back side of the user's legs. This advantageously provides comfort and protection of the back side of the user's legs when the user is sitting on a hard seating surface, such as metal bleacher type area.

Figure 2:
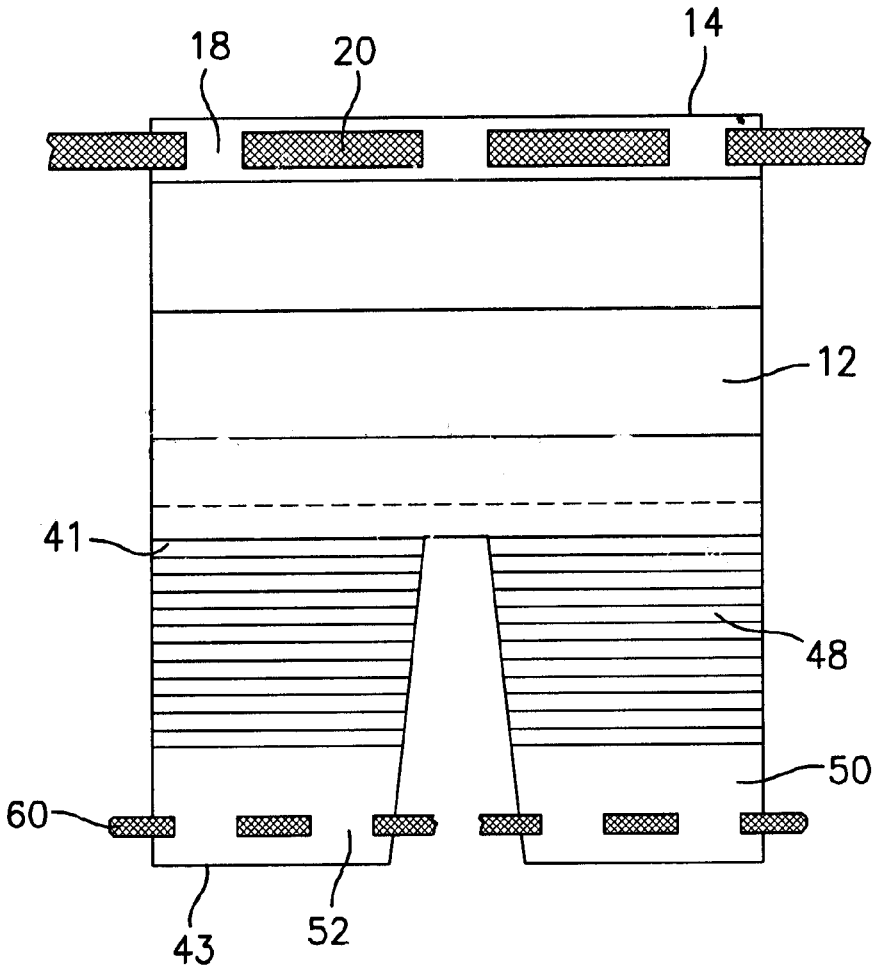
FIG. 2 is a rear elevation view of the body pad of FIG. 1.
Figure 3:
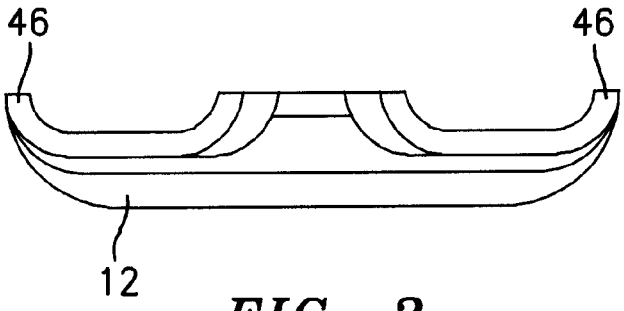
FIG. 3 is bottom plan view of the body pad of FIG. 1.

As best shown in FIG. 2, leg extensions 40 have a slight taper so that the topmost portion 41 of leg extension 40 is wider than the width of the bottommost portion 43 of leg extension 40. In one embodiment, topmost portion 41 has a width of about 8 inches and bottom most portion 43 has a width of about 7 inches. It being understood that these dimensions are merely exemplary in nature.

Preferably and in one embodiment, posterior portion 12 has a length of about 13 inches and a width of about 18 inches. Consequently, in a non-extended state, the over all length of body cushion 10 is about 23 inches.

Figure 6:
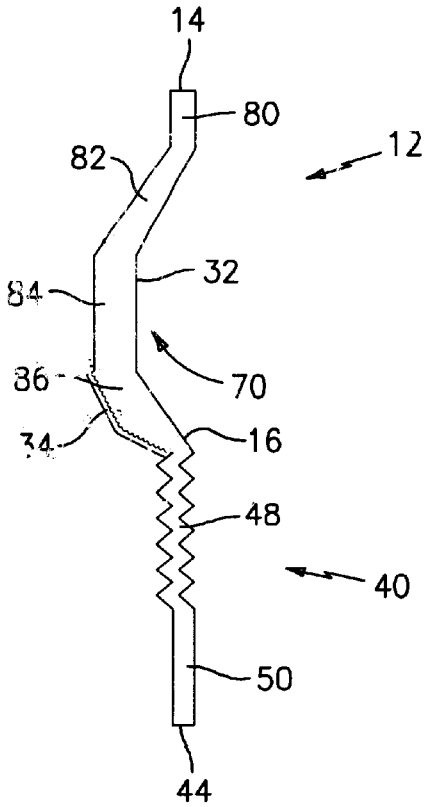
FIG. 6 is a side elevation view of the body pad of FIG. 4.
Figure 7A:
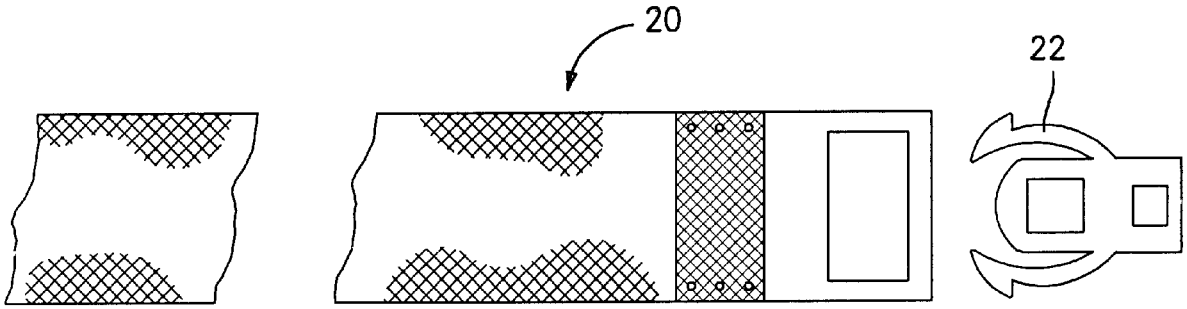
FIG. 7 is a side elevation view of exemplary belts for use with the body cushion of the present invention.
Figure 7B:
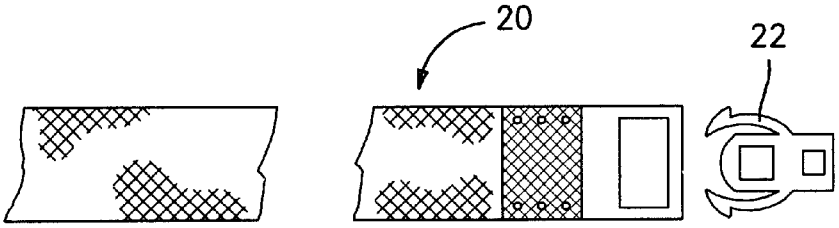

As best shown in FIG. 6, posterior portion 12 is slightly recessed between first end 14 and second end 16. This recessed area 70 is intended to accommodate the posterior of the user, while still providing a body contoured fit to the user's waist at first end 14 and a body contoured fit to the user's lower posterior area where one's legs join the buttocks. As best seen in FIG. 6, inner surface 32 in recessed area 70 is disposed approximately 2 inches below a plane containing first end 14 of posterior portion 12 and the top most portions of leg extensions 40.

Figure 4:
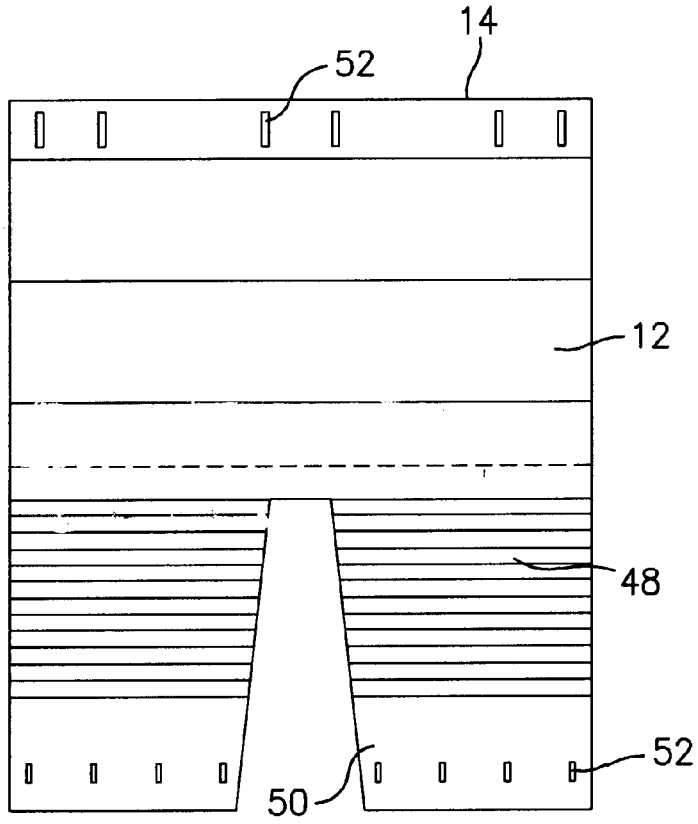
FIG. 4 is a rear elevation view of a second embodiment of the body pad of the present invention.
Figure 5:
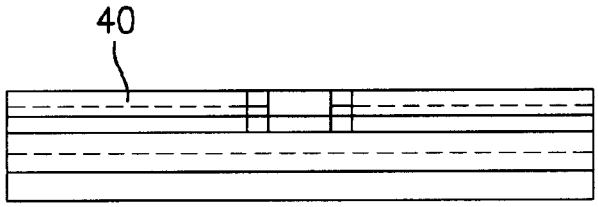
FIG. 5 is a bottom plan view of the body pad of FIG. 4.

FIGS. 4–6 illustrate a second embodiment of the present. In this second embodiment, leg extensions 40 are not arcuate in nature and comprise generally flat extensions. Pleated portion 60 is also included in this second embodiment.

As best shown in FIG. 6, posterior portion 12 includes four segments, namely an upper segment 80 which includes the plurality of slots 18, a first beveled surface 82 which is integral with upper segment 80; a central surface 84 integrally extending between first beveled surface 82 and a second beveled surface 86 which is integral to an upper end of leg extensions 40. The distance between a plane containing central surface 84 and a plane containing upper segment 80 is about 2 inches in the illustrated embodiment. The plurality of ribs 34 are formed on an outer surface of second beveled surface 86.

Body cushion 10 may be formed of a number of known materials by known processes. In an exemplary and preferred embodiment, body cushion 10 is formed of a polyvinyl chloride material using a high pressure molding process. As is known in the art, high pressure molding involves heating the material to liquid form and then injecting it into a mold. In the mold, the material expands to form body cushion 10 and then it is removed from the mold and allowed to cool. This process allows body cushion 10 to be formed in a variety of colors and thicknesses depending upon the end use and desired characteristics.

In another embodiment, body cushion 10 is formed from closed cell foams, i.e., sheet foams, using a thermal mold process. As is known, the material is initially provided in the form of sheets and it is then placed in a hot mold and is thermal molded to form body cushion 10. The foam sheets come in a variety of densities and colors, which allows the manufacturer to tailor the performance and appearance of the body cushion 10. The density of the material determines the thickness which is required. One conventional, closed cell foam is a neoprene foam. It is understood that the above-recited materials and processes are mentioned for purpose of illustration and it is within the scope of the present invention that other conventional processes and materials may be used.

While preferred embodiments have been shown and described, various modifications and substitutions may be made hereto without departing from the spirit and scope of the present invention. Accordingly, it is to be understood that the present invention has been described by way of illustrations and not limitation.

What is claimed is:

1. A body cushion, comprising:

a posterior portion for placement against the posterior of a user; and a pair of leg extensions integrally formed with the posterior portion and extending therefrom, the leg extensions for placement against the upper portions of the legs of the user, wherein each of the leg extensions includes extendable features which permit the leg extensions to extend and contract along a length thereof.

2. The body cushion of claim 1, wherein the posterior portion has a first end and an opposite second end, the first end for placement proximate the waist of the user, the posterior portion having a plurality of slots formed therein at the first end for receiving a waist fastener.

3. The body cushion of claim 1, wherein the posterior portion has an outer surface and an inner surface, the outer surface including a plurality of ribs.

4. The body cushion of claim 1, wherein each of the leg extensions includes a pleated portion having a plurality of extendable pleats so that each leg extension may be extended upon application or release of a force.

5. The body cushion of claim 1, wherein each of the leg extensions includes a plurality of slots for receiving a leg fastener.

6. The body cushion of claim 1, wherein the body cushion is formed of a closed cell material.

7. The body cushion of claim 1, wherein the body cushion is formed of polyvinyl chloride.

8. A body cushion, comprising:

a posterior portion for placement against the posterior of a user, the posterior portion having a first end section for placement about a waist of the user and a second end section, wherein the posterior portion has an arcuate shape; and a pair of leg extensions integrally formed with the posterior portion, the second end section thereof, and extending therefrom, the leg extensions for placement against backsides of legs of the user, the leg extensions having an arcuate shape and have extendable features which permit the leg extensions to expand and contract along a length thereof.

9. The body cushion of claim 8, wherein the extendable features comprise a plurality of pleats formed in each leg extension for permitting extension and contraction of the leg extension.

10. The body cushion of claim 8, wherein each leg extension includes a plurality of slots formed therein and a leg fastener disposed through the plurality of slots for fasteningly securing the leg extension to the leg.

11. The body cushion of claim 8, wherein the posterior portion has a plurality of slots formed therein for receiving a waist fastener.

12. The body cushion of claim 8, wherein an outer surface of the posterior portion has a plurality of ribs formed thereon for reducing slippage between the posterior portion and a contact surface.

13. The body cushion of claim 8, wherein the posterior portion has wrap around sides which seat against the user's body for a snug fit between the posterior portion and the user.

14. A body cushion, comprising:

a posterior portion for placement against the posterior of a user, the posterior portion having a first end section for placement about a waist of the user and a second end section;

a pair of leg extensions integrally formed with the posterior portion the second end section thereof and extending therefrom, the leg extensions for placement against backsides of legs of the user, the leg extensions being formed of expandable material, the leg extensions further including extendable features which permit a length thereof to be varied accordingly depending upon movement of the user; and means for securing each leg extension to one leg and the first end section of the posterior portion to the waist of the user.

15. The body cushion of claim 14, wherein the means are selected from the group consisting of hook and loop belts, interlockable belts, and belts with buckles.

* * * * *